United States Patent [19]

Howard

[11] 4,232,791

[45] Nov. 11, 1980

[54] WATERFALL CARPET DISPLAY

[76] Inventor: Fred Howard, 500 10th Ave., New York, N.Y. 10018

[21] Appl. No.: 807,690

[22] Filed: Jun. 17, 1977

[51] Int. Cl.[2] ..... A47F 7/16

[52] U.S. Cl. ..... 211/47; 24/255 R; 211/169.1; 248/441 R

[58] Field of Search ..... 211/45–48, 211/169–171, 150, 195; 248/441, 453, 188.7, 158; 312/183, 184; 24/255 R, 259 R

[56] References Cited

U.S. PATENT DOCUMENTS

| | | | |
|---|---|---|---|
| 236,685 | 1/1881 | Massey | 248/441 |
| 2,123,774 | 7/1938 | Forthoffer | 211/169.1 |
| 2,200,812 | 5/1940 | Ward | 24/259 R X |
| 2,919,812 | 1/1960 | Best et al. | 211/45 |
| 2,946,454 | 7/1960 | Asher | 211/45 |
| 2,964,198 | 12/1960 | Eisbart | 211/45 |
| 3,106,920 | 10/1963 | Scholfield et al. | 211/50 X |
| 3,185,308 | 7/1964 | Howard | 211/45 |
| 3,195,733 | 7/1965 | Best | 211/45 |
| 3,235,093 | 2/1966 | Eisbart et al. | 211/169 X |
| 4,044,928 | 8/1977 | Watanabe | 24/255 R X |
| 4,063,648 | 12/1977 | Fuller et al. | 211/45 |

FOREIGN PATENT DOCUMENTS

| | | | |
|---|---|---|---|
| 739794 | 8/1966 | Canada | 211/45 |
| 822980 | 9/1969 | Canada | 248/188.7 |

*Primary Examiner*—Roy D. Frazier

*Attorney, Agent, or Firm*—Cushman, Darby & Cushman

[57] ABSTRACT

A carpet display assembly including a number of carpet sample clamps for receiving an edge of carpet samples, and a pair of supports disposed at an angle of greater than 90° with respect to each other. The support members mount the clamps so that carpet samples received by the clamps may lay flat in a substantially horizontal plane in a first position thereof, and may be pivoted more than 90° from the first position and disposed in a second, flipped-over, supported position. In this way, each sample will be displayed in a substantially horizontal position—for proper viewing—and each sample is fully visible when the overlapping sample is flipped-over, the flipped-over samples do not require holding in their flipped-over position, but rather are naturally supported in that position. Each clamp may comprise an integral structure of resilient material having a pair of legs adapted to clamp the carpet sample therebetween, one of the legs providing an inclined portion for guiding a rod-receiving portion of the clamp into clamping engagement with a mounting rod disposed on the second support member. A stand may be provided for supporting the first support member in a substantially horizontal plane.

14 Claims, 7 Drawing Figures

WATERFALL CARPET DISPLAY

BACKGROUND AND SUMMARY OF THE INVENTION

The invention relates to a carpet sample display assembly that provides an "edge peak" waterfall presentation. Prior art carpet sample display assemblies do not always present the samples in a full horizontal position, although a carpet sample should be displayed in a full horizontal position for proper viewing by the prospective customer. Additionally, in prior art carpet displays when one overlapping sample was flipped upwardly, the underlying sample was not fully visible (see U.S. Pat. No. 3,185,30) and/or it was necessary that a salesman or the customer manually hold the overlaying samples in a vertical position when viewing an underlying sample, or accessory holding mechanisms were necessary (see U.S. Pat. No. 3,235,093). Prior art display assemblies also make it difficult to remove samples out of order and to readily replace one sample with another, or they do not provide secure support for the samples.

According to the present invention, a carpet display assembly is provided that eliminates all of the drawbacks in prior art carpet assemblies as discussed above, while still providing a display assembly that is relatively simple and easy to produce.

According to the present invention, a carpet display assembly is provided comprising a plurality of carpet sample clamps, each clamp including means for receiving an edge of a carpet sample; and means for mounting the plurality of clamps so that samples received thereby may lay flat in a substantially horizontal position in a first position thereof and may be pivoted more than 90° from the first position and disposed in a second, flipped over, supported position—the mounting means comprising first and second substantially planar relatively rigid support members, the support members joined tpgether along a cooperating edge of each, and the members making an angle $\alpha$ of greater than 90° with respect to each other. The angle $\alpha$ may be any angle greater than 90° providing for a second, flipped-over, supported position of the carpet samples—exemplary angle $\alpha$ is 148°.

The mounting means for the clamps also preferably include rod means affixed to and having portions extending parallel to the second support member, the clamps including rod-receiving portions receiving the rod means and pivotally mounted with respect to the second support member by the rod means. The rod means may include a number of spaced individual rod segments disposed in pairs—and the segments in each pair spaced from each other. This allows the insertion of a clamp into engagement therewith either by a straight pushing caming action, or by insertion of one segment into one end of the clamp rod-receiving portion, and a straight line, caming movement of the other end. The clamp portion for receiving a carpet sample edge preferably extends along the entire width of a carpet sample received thereby, and resiliently clamps the carpet edge.

Each clamp may be formed as an integral structure from resilient material, with a pair of leg members resiliently biased together to clamp a carpet sample therebetween. At least one of the leg members may have a tapered free-end terminal portion thereof facilitating penetration of the pile of a carpet sample for secure holding thereof (as in U.S. Pat. No. 3,185,308). The rod-receiving portion may have a cam portion formed therewith co-operating with an incline portion of one of the leg members for guiding movement of the rod-receiving portion into operative relationship with a rod segment. The rod segments are vertically spaced along the second support member a distance substantially equal to the thickness of the carpet sample held by the clamp associated therewith. Additionally, a removeable stand may be provided for supporting the support members so that the first support member is disposed in a substantially horizontal plane.

By utilizing a display assembly according to the present invention, the size of carpet samples displayed can be greatly reduced compared to prior art presentations while still being equivalent thereto as far as the degree of visibility provided. For instance, an 18 inch by 24 inch display assembly according to the present invention provides visibility equivalent to existing presentations employing 24 inch by 36 inch or 24 inch by 48 inch samples.

It is the primary object of the present invention to provide a carpet sample display assembly that presents all of the samples in a substantially full horizontal position, each sample being fully visible, and eliminating the need for manual holding of overlapping carpet samples in a vertical position for viewing underlying samples. This and other objects of the invention will become clear from an inspection of the detailed description of the invention, and from the appended claims.

DETAILED DESCRIPTION OF THE INVENTION

Figure 1:
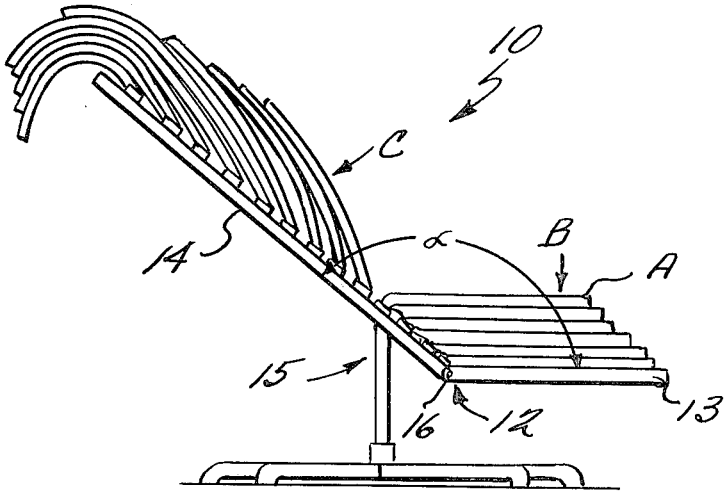
FIG. 1 is a perspective view of an exemplary display according to the present invention illustrating the fully horizontal position, "edge peak" waterfall presentation according to the invention.

The invention relates to a carpet display assembly that provides an "edge peak" waterfall presentation with each sample in a substantially full horizontal position, and with each sample fully visible, overlaying samples being disposable in a naturally supported position allowing full visibility of the underlying samples. An exemplary assembly according to the prsent invention is shown generally at 10 in FIG. 1. The assembly 10 includes a plurality of carpet sample clamps 11 (see FIGS. 3 through 5), each clamp receiving an edge of a carpet sample A, and means 12 for mounting the plurality of clamps 11 so that samples A received thereby may lay flat in a substantially horizontal plane in a first position thereof (see position B in FIG. 1), and may be pivoted more than 90° from the first position (B) and disposed in a second, flipped-over, supported position (see position C in FIG. 1). The mounting means 12 comprises first and second substantially planar relatively rigid support members 13 and 14 respectively, the support members being joined together along a co-operating edge 16 of each, and the members 13, 14 making an angle $\alpha$ of greater than 90° with respect to each other (see FIG. 1). A stand 15 may be provided for supporting the members 13, 14 so that the member 13 is disposed in a substantially horizontal plane (see FIG. 1).

The clamp mounting means also preferably includes a rod means 17 (see FIG. 2 in particular) disposed along the length of the second support member 14. The rod means 17 includes a plurality of spaced rod segments 21, each rod segment for receipt by a clamp 11. The rod segments are vertically spaced a distance V substantially equal to the thickness of a carpet sample A held by a clamp 11 associated therewith. The vertical spacing may be dimensioned to accommodate the thickest commercial carpet to be displayed, and will therefore also accommodate thinner carpets. The spacing along the member 14 $S = V \cdot \text{cosec}(180° - \alpha)$ where V = the vertical spacing. The angle $\alpha$ may be any angle greater than 90° that, combined with the relative rod spacings, lengths of the samples A, etc., accomplishes the objective of fully visible, horizontal display of each carpet sample without need for manual support of overlapping samples, according to the present invention. A typical example $\alpha$ that accomplishes these purposes is 148°. Such an angle $\alpha$ provides a true "edge peak" waterfall display while accomplishing the objectives according to the invention.

Figure 2:
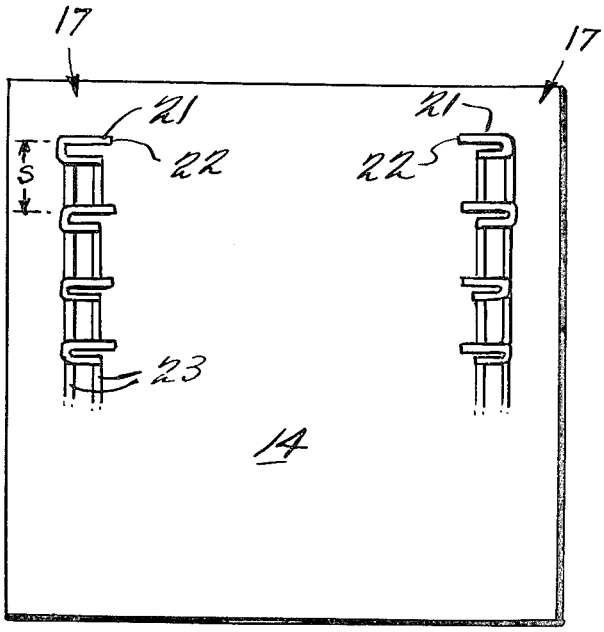
FIG. 2 is a detailed perspective view of exemplary rod means utilized with the structure FIG. 1.

Preferably the rod segments 21 include individual rod segments disposed in pairs with the free ends 22 thereof spaced from each other on the support member 14 (see FIG. 2). The segments 21 may be welded or otherwise attached to rods 23 extending along the length of the member 14 rigidly affixed to the member 14. When spaced, paired, individual rod segments 21 are provided, it is possible to attach the clamps 11 thereto in either of two different ways.

Figure 3:
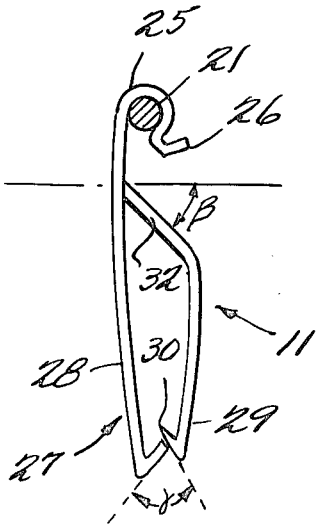
FIG. 3 is a side view of an exemplary clamp according to the present invention.
Figure 4:
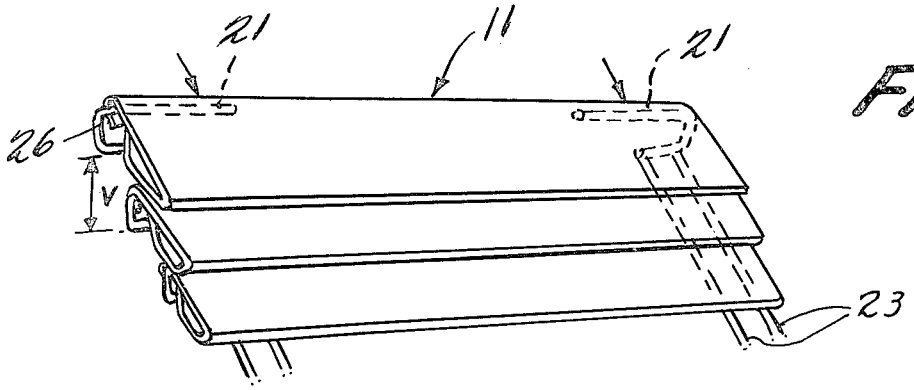
FIG. 4 is a schematic view showing the use of the clamp of FIG. 3 in mounting to the rod means of FIG. 2.

An exemplary clamp 11 according to the present invention is shown most clearly in FIGS. 3 and 4. The clamp includes a rod (21) receiving portion 25 thereof, and means 27 for receiving an edge of a carpet sample A (or a number of samples end-to-end). The rod-receiving portion 25 preferably includes a free-end cam portion 26 thereof which facilitates movement of the rod-receiving portion 25 into operative association with a rod 21. The clamp 11 preferably is provided as an integral structure formed of resilient material (i.e. molded as a single piece of plastic) including first and second opposed leg members 28, 29. The natural resiliency of the material from which the clamp 11 is made biases the leg members 28, 29 together for clamping engagement of a carpet sample.

At least the second leg member 29 of the clamp 11 may have a tapered terminal portion 30 thereof (as described in U.S. Pat. No. 3,185,308) that facilitates penetration of the pile on the face of the carpet sample. Additionally, the second leg member 29 preferably includes an inclined portion 32 thereof—making an angle $\beta$ with respect to a perpendicular to leg member 28 (see FIG. 3), the angle $\beta$ for example being about 32°. The inclined portion 32 co-operates with the cam portion 26 of the clamp 11 to guide the rod-receiving portion 25 into receivig relationship with the rod 21. This is especially important when the clamp is attached to the rod with the leg member 28 facing the operator. The free ends of the leg members 28, 29 make a positive angle $\gamma$ (see FIG. 3.) with respect to each other.

Figure 5A:
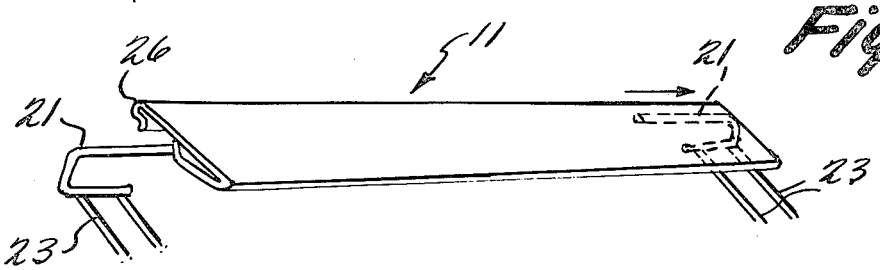
FIGS. 5*a* and 5*b* are sequential schematic views illustrating an alternative use of the clamp of FIG. 3 in bringing it into operative relationship with the rod means of FIG. 2.
Figure 5B:
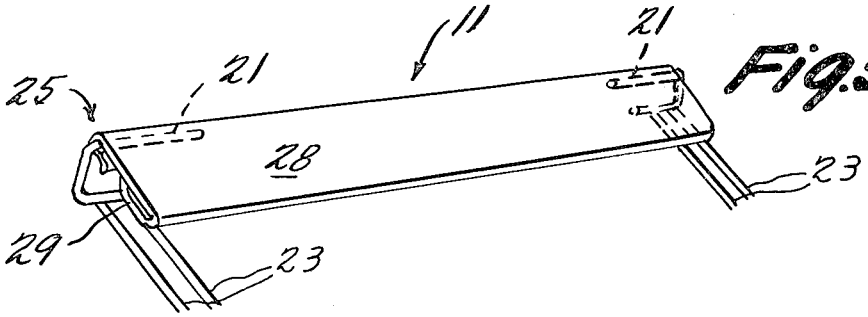

The alternative ways in which each clamp 11 may be moved into operative relationship with the rods 21 are shown in FIGS. 4, and 5*a* and 5*b* respectively. In FIG. 4, the member 11 is disposed with respect to the rod segments 21 so that the rod segments 21 are received between the portions 32 and 26, and then a linear force is applied to the clamp 11 to move it with respect to the segments 21, the portions 26 being cammed upwardly by the segments 21 to provide a large enough opening so that the rod-receiving portion 25 clamps onto the rods 21. According to another manner of operation, as shown in FIG. 5*a* one end of the clamp 11 is moved parallel to the direction of elongation of one of the segments 21 so that the segment 21 slides into receiving engagement by the rod-receiving portion 25. Then, as shown in FIG. 5*b*, the other end of the clamp 11 is moved in a arc substantially perpendicular to the direction of elongation of the other rod segment 21, the cam portion 26 again being moved outwardly (because of the resilient nature of the material of clamp 11) until the rod-receiving portion 25 does receive the segment 21. The clamps may be readily inserted and removed so that various carpet samples A may be removed from a presentation and others inserted in their place, or for closer inspection.

Figure 6:
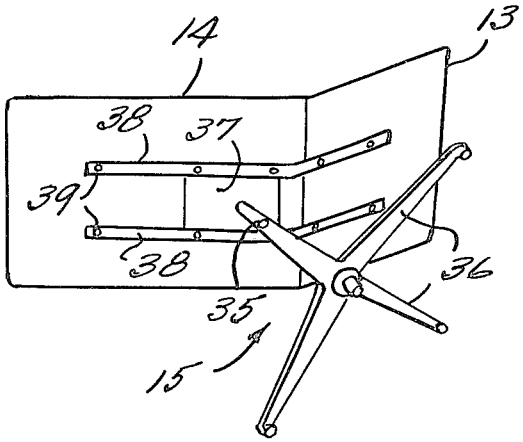
FIG. 6 is a bottom view of the structure of FIG. 1 showing in detail the connection of the stand to the support members.

An exemplary stand 15 that may be utilized according to the present invention is illustrated in FIG. 6. The stand includes a vertically extending portion 35 and a plurality of leg supports 36 attached to the vertical rod 35. A plate 37 attached to the opposite end of the rod 35 as the legs 36 engages the back of one of the members 13, 14 (whichever member is longer), member 14 being engaged in FIG. 6. A pair of bars 38 are attached to the support members 13, 14—as by wing nuts 39 with co-operating screws—and hold the plate 37 in clampig engagement against the support member 14 back. To readily disassemble the stand—for ease of transportion or to place another display thereon—it is only necessary to loosen the wing nuts 39, and slide and/or pull the plates 37 out of engagement with the support member 14 back.

It will thus be seen that according to the present invention a carpet display assembly is provided that effects an "edge peak" waterfall presentation of carpet samples, each sample being viewable in a substantially fully horizontal position, and the full extent of each sample being visible. Because of the full visibility of the samples, 18 inch by 24 inch carpet samples A utilized in the assembly 10 according to the invention is equivalent to existing presentations (i.e. FIG. 1 of U.S. Pat. No. 3,185,308) employing much larger samples (such as 24 inch by 36 inch or 24 inch by 48 inch). Additionally, according to the present invention each overlaying sample is naturally supported when in its flipped-over second position, eliminating the necessity for manual holding of the overlying samples in a vertical position to view the underlying samples.

While the invention has been herein shown and described in what is presently conceived to be the most practical and preferred embodiment thereof, it will be apparent to those of ordinary skill in that art that many modifications may be made thereof within the scope of the invention, which scope is to be accorded the broadest interpretation of the appended claims so as to encompass all equivalent structures and devices.

What is claimed is:

1. A carpet display assembly comprising a plurality of carpet sample clamps, each clamp including means for receiving an edge of a carpet sample, and means for mounting said plurality of clamps so that all samples received thereby may lay flat in a substantially horizontal plane in a first position thereof, and may be pivoted more than 90° but less than 180° from said position and disposed in a second limp flipped-over, supported position, said mounting means comprising first and second substantially planar relatively rigid support members, said support members joined together along a co-operating edge of each, and said member making an angle $\alpha$ of greater than 90° with respect to each other; said mounting means further comprising rod means affixed to, and having portions extending parallel to, said second support member, said rod means receiving said clamps for pivotally mounting said clamps with respect to said support members; and wherein said rod means include a plurality of spaced individual rod segments, disposed in pairs along the length of said second support member, each rod segment having a portion extending generally parallel to said second support member toward its paired rod segment, the rod segment of each pair having free ends that are spaced from each other.

2. A carpet display assembly as recited in claim 1 wherein said angle $\alpha$ is around 148°.

3. A carpet display assembly as recited in claim 1 wherein each of said clamps includes a rod-receiving portion thereof that extends substantially along the length thereof, said length being sufficient to receive both rod segments of a pair of rod segments and span the space therebetween.

4. A carpet display assembly as recited in claim 3 wherein said means for receiving a carpet sample edge of each clamp includes first and second opposed leg members, each leg member extending substantially across the width of a carpet sample received thereby.

5. A carpet display assembly as recited in claim 4 wherein at least said second leg member is formed of resilient material so that when a carpet sample is received by said leg members said second leg member will be urged toward the other leg member to clamp the carpet sample therebetween.

6. A carpet display assembly as recited in claim 4 wherein said second leg member includes a connecting portion operatively connecting it to said rod-receiving portion, said connecting portion providing an inclined surface for guiding said rod-receiving portion into receiving relationship with said rod means.

7. A carpet display assembly as recited in claim 6 wherein said rod-receiving portion includes a cam portion for co-operating sith said connecting portion of said second leg member for guiding said rod-receiving portion into receiving relationship with said rod means.

8. A carpet display assembly as recited in claim 1 further comprising a stand means for supporting said support members so that said first support member is disposed in a substantially horizontal plane; and wherein said mounting means further include rod-receiving portions formed on said clamps for receipt of said rod means for mounting said clamps for pivotal movement with respect to said second support member.

9. A carpet display assembly as recited in claim 8 wherein said rod segments are vertically spaced along said second support member a distance substantially equal to the thickness of a carpet sample held by the clamp associated therewith.

10. A carpet display assembly as recited in claim 8 wherein each said clamp includes first and second leg members for clamping a carpet sample therebetween, each said rod receiving portion being spaced from said leg members, and said second leg member having an inclined portion thereof for guiding said rod-receiving portion into receiving relationship with said rod means.

11. A carpet display assembly as recited in claim 10 wherein said clamp member rod-receiving portion includes a cam portion for co-operating with said inclined portion of said second leg member for guiding said rod-receiving portion into receiving relationship with said rod means.

12. A carpet display assembly as recited in claim 1 wherein each said clamp comprises an integral structure formed of generally resilient material, and wherein said carpet sample edge receiving means comprises first and second leg members having free end portions urged together by the natural resiliency of said clamp material, and making a positive angle with respect to each other.

13. A carpet display assembly as recited in claim 12 wherein at least said second leg member free end portion is tapered to facilitate penetration of the mass of piles of a carpet sample received thereby.

14. A carpet display assembly as recited in claim 13 wherein said second leg member includes an inclined portion cooperating with a cam portion of said rod-receiving portion for guiding said rod-receiving portion into receiving relationship with said rod means.

* * * * *